US009555864B2

(12) United States Patent
Meskers

(10) Patent No.: US 9,555,864 B2
(45) Date of Patent: Jan. 31, 2017

(54) DAMPING DEVICE FOR A VESSEL

(75) Inventor: Gerardus Petrus Meskers, Leiden (NL)

(73) Assignee: Heerema Marine Contractors Nederland SE, Leiden (NL)

( * ) Notice: Subject to any disclaimer, the term of this patent is extended or adjusted under 35 U.S.C. 154(b) by 312 days.

(21) Appl. No.: 14/233,720

(22) PCT Filed: Jul. 19, 2012

(86) PCT No.: PCT/NL2012/050517

§ 371 (c)(1),
(2), (4) Date: May 13, 2014

(87) PCT Pub. No.: WO2013/015684

PCT Pub. Date: Jan. 31, 2013

(65) Prior Publication Data

US 2014/0238948 A1 Aug. 28, 2014

Related U.S. Application Data

(60) Provisional application No. 61/510,699, filed on Jul. 22, 2011, provisional application No. 61/545,668, filed on Oct. 11, 2011.

(30) Foreign Application Priority Data

Jul. 22, 2011 (NL) ..... 2007165

(51) Int. Cl.
*B63B 39/02* (2006.01)
*B66C 13/06* (2006.01)
(Continued)

(52) U.S. Cl.
CPC ..... *B63B 39/02* (2013.01); *B63B 27/10* (2013.01); *B63J 3/04* (2013.01); *B66C 13/06* (2013.01); *B66C 23/52* (2013.01); *B66C 23/53* (2013.01)

(58) Field of Classification Search
CPC ..... B66C 23/53; B66C 13/06; B66C 13/063; B66C 23/52; B66C 23/525; B63B 39/02; B63B 27/10; B63B 27/12
(Continued)

(56) References Cited

U.S. PATENT DOCUMENTS 3,107,791 A 10/1963 Bayard
6,439,407 B1 * 8/2002 Jacoff ..... B66C 13/08 212/272
(Continued)

FOREIGN PATENT DOCUMENTS

GB 2252295 8/1992

OTHER PUBLICATIONS

Search Report and Written Opinion dated Oct. 2, 2012 for International Application No. PCT/NL2012/050517.
(Continued)

*Primary Examiner* — Andrew Polay

(57) ABSTRACT

The present invention relates to a vessel comprising:-a hull,-a support structure connected to said hull, the support structure configured for supporting the mass, the support structure being constructed to allow the mass to make a back and forth movement relative to said hull along a trajectory between opposite ends of said trajectory,-a damping device configured to dampen the movement of the mass relative to said hull. The present invention also relates to a method for damping the movements of a vessel or of a mass.

12 Claims, 15 Drawing Sheets

(51) Int. Cl.

| | |
|---|---|
| ***B66C 23/52*** | (2006.01) |
| ***B66C 23/53*** | (2006.01) |
| ***B63B 27/10*** | (2006.01) |
| ***B63J 3/04*** | (2006.01) |

(58) Field of Classification Search
USPC ..... 212/273, 274, 275, 307–311; 114/122, 114/124
See application file for complete search history.

(56) References Cited

U.S. PATENT DOCUMENTS

| | | | | |
|---|---|---|---|---|
| 7,063,306 | B2 | 6/2006 | Sanders et al. | |
| 8,499,708 | B2 * | 8/2013 | Roodenburg | B63B 39/00 114/124 |
| 2009/0232625 | A1 | 9/2009 | Almeda, Jr. et al. | |
| 2010/0307401 | A1 * | 12/2010 | Bereznitski | B63B 39/02 114/122 |
| 2011/0100279 | A1 | 5/2011 | Roodenburg et al. | |

OTHER PUBLICATIONS

Search Report and Written Opinion dated Mar. 21, 2012 for Netherland Application No. NL2007165.
Mexican Office Action dated May 26, 2016, in corresponding application No. MX/a/2014/000858.

* cited by examiner 16
12
32
34
53
Y
14

66
0
67
64
60

68
0
0
4
8
12
Time [s]

60
0
0
4
8
12
Time [s]

66
67
64
0
4
8
12
Time [s]

DAMPING DEVICE FOR A VESSEL

This application is the National Stage of Internationa Application No. PCT/NL2012/050517, filed Jul. 19, 2012, which claims benefit of Netherlands Patent Application No. 2007165, filed Jul. 22, 2011, and which claims benefit of U.S. Provisional Application No. 61/510,699, filed Jul. 22, 2011, and which claims benefit of U.S. Provisional Application No. 61/545,668, filed Oct. 11, 2011.

FIELD OF THE INVENTION

The present invention relates to a method of damping the motion of a vessel. The present invention further relates to a method of damping the motion of a mass suspended from a suspension point on a support structure of a vessel. The present invention further relates to a vessel comprising a damping device.

BACKGROUND AND PRIOR ART

In the field of marine operations, operations at sea are often carried out with vessels. An operation may be a lifting operation, a pipeline laying operation, an installation operation or a removal operation of a structure such as a wind turbine or a drilling platform, a rescue or salvage operation, a drilling operation for drilling hydrocarbons. Other operations may be a loading or unloading operation of a vessel at sea. Other operations may include the collecting and processing of hydrocarbons on an FPSO or other kind of vessel, or the unloading of the collected hydrocarbons from the FPSO to a shuttle tanker.

Other operations may include the launch of a space rocket from a marine platform or the collecting of data with a research vessel. Many other operations are performed at sea in the field of the art.

Generally, wind, waves and currents exert forces on the vessel, which forces cause movements of the vessel. In some cases, the natural period of the waves approximates or equals the natural period of a vessel. In that case, the vessel may tend to roll to substantial roll angles and have motions which are undesirable.

In some cases, these motions hinder the execution of the operation itself. It may be desirable to reduce the motions of the vessel at certain times.

SUMMARY OF THE INVENTION

The invention relates to a vessel comprising:

a hull, a support structure connected to said hull, the support structure configured for supporting a mass, the support structure being constructed to allow the mass to make a back and forth movement relative to said hull along a trajectory between opposite ends of said trajectory, a damping device configured to dampen the movement of the mass relative to said hull.

In an embodiment, the trajectory is curved.

In an embodiment, the support structure extends over a vertical distance from a centre of gravity of the vessel, providing a suspension point at a vertical distance from the centre of gravity of said hull, the damping device further comprising an elongate suspension organ via which the mass is suspended as a pendulum from the suspension point, the mass being able to make a pendular movement relative to said hull, wherein the damping device is configured to dampen the pendular movement of the mass relative to the hull.

In an embodiment, the damping device comprises an energy dissipation device constructed to dissipate energy from the moving mass.

In an embodiment, the damping device comprises at least one elongate damping organ which connects at least one support point on the hull with the mass and which is constructed to apply a damping force on the mass. The elongate damping organ will generally be a cable or line.

In an embodiment, the elongate damping organ is extendable and constructed to:

extend during a movement of the mass away from the support point, and shorten during a movement of the mass toward the support point.

The extension may be provided by extending the elongate damping organ itself or by providing extra length.

In an embodiment, the elongate organ is a line, and the damping device comprises:

a winch on which one end of the line is spooled, and an energy dissipation device which is coupled to the winch.

In an embodiment, the energy dissipation device comprises a generator which is coupled to the winch and which is constructed to operate as:

a dynamo when the line is spooled off the winch when the mass moves away from the support point, thereby generating electric power and an electric motor when the mass moves in the direction of the support point, thereby spooling the line onto the winch by providing electric power while at the same time maintaining a tension on the line in order to keep the line taut.

In an embodiment, the damping device is a passive device, requiring substantially no energy for damping the movement of the mass relative to said hull. If a generator is used, the spooling of the line onto the winch requires some energy, but relatively little in comparison with the amount of electrical energy which is generated when the mass moves away from the support point and pulls the line off the winch, thereby driving the generator which works as a dynamo.

In an embodiment, the support structure extends upwards from the hull, and wherein the mass is provided above the water level. In an embodiment, the support structure extends upwards from the hull, and wherein the mass is supported higher than the upper deck of the hull, wherein at least a part of the trajectory extends above the upper deck. The free space above the deck allows a substantial freedom of movement for the mass.

In an embodiment—when seen in top view—the trajectory is located eccentric to a longitudinal plane of symmetry of said hull.

In an embodiment—when seen in top view—the suspension point is located outboard of the perimeter of the hull, in particular on the right side or left side of the vessel. The suspension point is located at a horizontal distance from the center of gravity of the vessel.

In an embodiment, the support structure is a crane. A crane may already be present on a vessel for other reasons, and can be used for stabilizing the vessel as well.

In an embodiment, the support structure is positioned near the bow or stern of the vessel, in particular at a distance of less than 15 percent of a total length of the vessel.

In an embodiment, the damping device comprises:

at least one speed sensor which is configured to measure a payout speed of the line from the winch and to generate a speed signal on the basis of the measured speed, at least one tension sensor which is configured to measure a tension in the line and to generate a tension signal on the basis of the measured tension, a control unit which is coupled to the speed sensor and to the tension sensor, the control unit being configured to:

determine a desired tension in the line on the basis of the speed signal and a stored relationship between the payout speed and the tension force, and control the energy dissipation device in dependence of a difference between the desired tension and the actual tension measured by the tension sensor.

In another embodiment, the damping device does not comprise a sensor for measuring the speed or tension but only provides a direct relationship between the payout speed of the line and the tension. This allows a relatively simple damping device.

In an embodiment, the damping device is constructed and arranged to provide a damping force which is:

substantially linearly dependant on the speed of the mass, or substantially a step function of the speed of the mass, wherein the damping force has a first substantially fixed value when the mass moves in one direction, and wherein the damping force has a second substantially fixed value when the mass moves in substantially the opposite direction.

In an embodiment, the damping device is constructed to provide a damping force on the mass which is maximized, i.e. if the speed of the mass exceeds a certain value, the damping force does not exceed a predetermined maximum value.

In an embodiment, the damping device is constructed to provide a damping force on the mass which is minimized for a maximum speed of the mass in a direction toward the support point, i.e. if the speed of the mass in a direction toward the support point on the hull exceeds a certain value, the damping force on the line does not fall below a predetermined minimum, in order to ensure that the line remains taut.

In an embodiment, the elongate damping organ comprises a piston with a dampener. With this embodiment, a direct dampening of the movement of the mass is possible.

In an embodiment, the vessel does not comprise a rail constructed for guiding the moving mass. The leaving out of a rail results in a relatively simple construction In an embodiment, the moment of inertia of the vessel without the mass about a roll axis of the vessel is less than a factor 10, preferably less than a factor 5 greater than the moment of inertia of the mass about the suspension point.

In an embodiment, the support point is provided at a distance of less than 30% of the width of the vessel above a center of gravity of the vessel.

In an embodiment, the damping device comprises at least a first and second elongate damping organ, and at least a first and second support point, wherein the first support point and second support point are spaced apart in a direction perpendicular to the trajectory.

With this embodiment, it is relatively easy to control the movements of the mass, and it is in particular possible to control the orientation of the mass.

In an embodiment, the damping device comprises:

a first line, which connects a first support point on the hull with the mass, and which is constructed to apply a first damping force on the mass, a first winch on which one end of the first line is spooled, a first energy dissipation device which is coupled to the first winch, and a second line, which connects a second support point on the hull with the mass and which is constructed to apply a second damping force on the mass, a second winch on which one end of the second line is spooled, a second energy dissipation device which is coupled to the second winch, wherein the first winch and second winch are spaced apart in a direction perpendicular to the trajectory.

In an embodiment, the support structure extends over a horizontal distance from the hull and is constructed and arranged to support the mass at a substantial depth under water via the elongate suspension organ, wherein the elongate suspension organ has an elasticity and is constructed to act as a spring which allows an up-and-down oscillation of the mass when the vessel makes a rolling movement, wherein the damping device comprises a line which extends substantially vertically from the vessel to the mass, the line being coupled to an energy dissipation device and being constructed to apply a damping force on the mass.

The invention further relates to a damping device constructed and arranged for damping the movement of a vessel or of a mass, the damping device comprising:

a support structure constructed to be positioned on a vessel and configured for supporting the mass, the support structure being constructed to allow the mass to make a back and forth movement relative to said hull along a trajectory, between opposite ends of said trajectory an energy dissipation device, a connection organ constructed to connect a support point on a hull of a vessel with a movable mass.

The present invention further relates to a method of stabilizing a mass or a vessel, the method comprising:

providing an assembly comprising a vessel and a mass, wherein the vessel comprises:

a hull, a support structure connected to said hull, the support structure configured for supporting the mass, the support structure being constructed to allow the mass to make a back and forth movement relative to said hull along a trajectory between opposite ends of said trajectory, a damping device configured to dampen the movement of the mass relative to said hull, damping a movement of the mass relative to the vessel with the damping device.

In an embodiment, the method comprises:

providing a support structure which extends over a vertical distance from said hull, thereby providing a suspension point at a vertical distance from said hull, the assembly further comprising an elongate suspension organ via which the mass is suspended as a pendulum from the suspension point, the mass being able to make a pendular movement relative to said hull, the pendular movement defining the trajectory, wherein the damping device is configured to dampen the pendular movement of the mass, allowing the mass to make a pendular movement, damping a movement of the mass relative to the vessel with the damping device.

In an embodiment, the method comprises dampening the roll motion of the vessel about at least one axis.

In an embodiment, the method comprises:

providing the assembly in a marine environment with substantial waves which cause the mass to make a pendular movement, converting the consumed energy of the moving mass in electrical energy, making use of the generated electrical energy by:

providing the generated electrical energy to a power grid via a power cable, and/or storing the electrical energy, and/or converting the electrical energy into another energy form, for instance by creating hydrogen or by pumping water to a greater altitude.

In an embodiment, the vessel comprises a reeling device for laying pipeline, the method comprising transferring a reel with pipeline spooled onto the reel to the vessel, 10 wherein the damping device is used to dampen the motion of the reel and/or the vessel during the transfer of the reel.

In an embodiment, the method comprises:

providing a control unit which is coupled to at least one speed sensor, to at least one tension sensor and to the energy dissipation device, and measuring a payout speed of the line from the winch with the speed sensor and generating a speed signal on the basis of the measured speed, measuring a tension in the line with the tension sensor and generating a tension signal on the basis of the measured tension, determining a desired tension in the line on the basis of the speed signal and a stored relationship between the payout speed and the tension force by the control unit, and controlling the energy dissipation device in dependence of a difference between the desired tension and the actual tension by the control unit.

LIST OF FIGURES

The above mentioned aspects and other aspects of the invention will be more readily appreciated as the same becomes better understood by reference to the following detailed description and considered in connection with the accompanying figures in which like reference symbols designate like parts.

DETAILED DESCRIPTION OF THE FIGURES

Figure 1A:
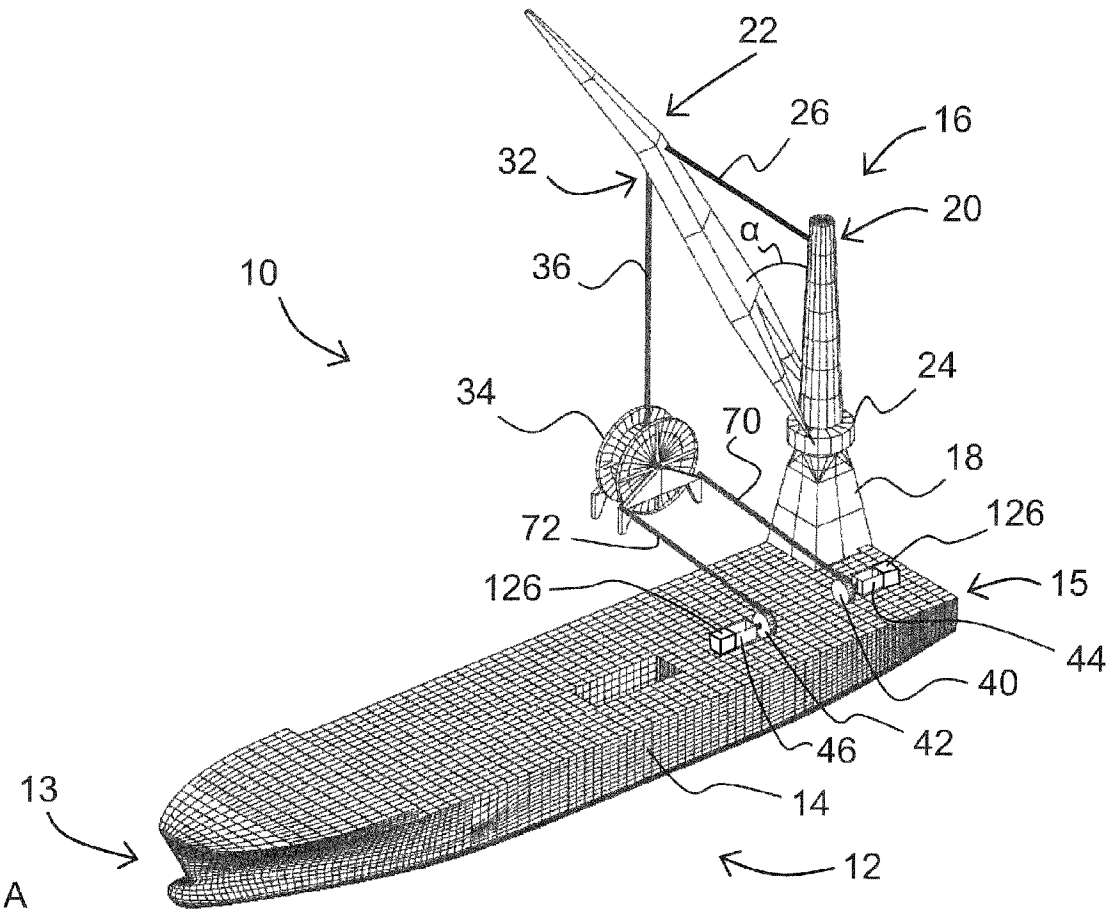
FIG. 1A shows a birdseye view of an embodiment of the vessel according to the invention.

Turning to FIGS. 1A, 1B, 2A, 2B and 3A, an embodiment of the assembly 10 according to the invention is shown. A vessel 12 is provided, having a hull 14. The hull 14 is a monohull. The hull 14 can be of various size and shape, as a skilled person will understand. The vessel 12 can be a conventional monohull ship, a semi submersible, a barge, a caisson, or a different kind of vessel.

The vessel 12 has a bow 13 and a stern 15. The vessel has an upper deck 21. The vessel has a moonpool 29 for pipe lay operations.

The natural roll period of the vessel may be 13 seconds or between 10 and 20 seconds.

Figure 1B:
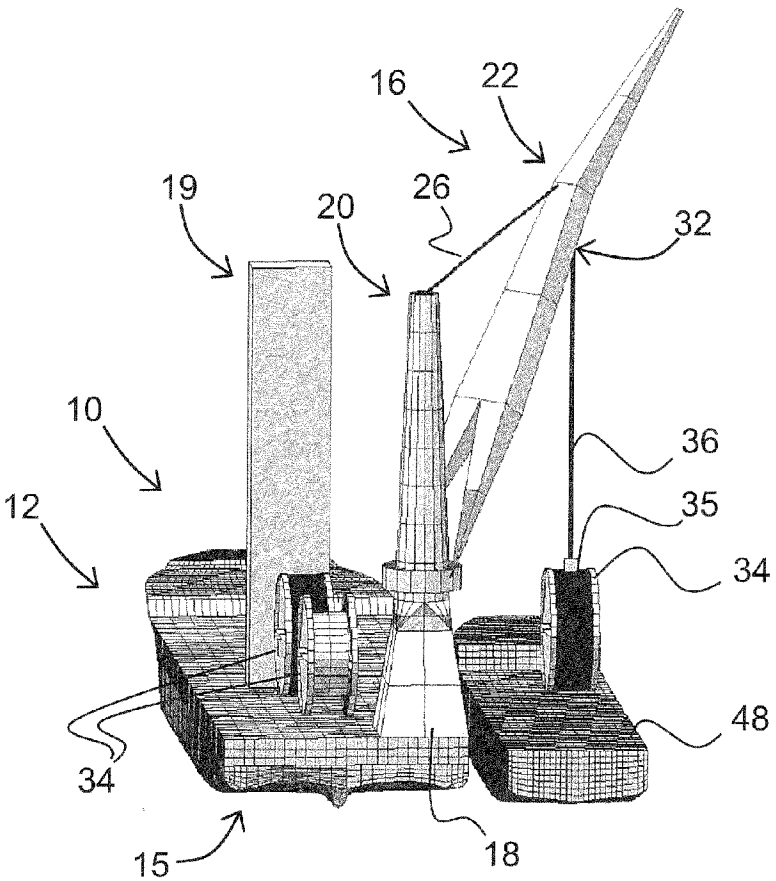
FIG. 1B shows a birdseye view of an embodiment of the vessel according to the invention in operation.

The vessel may comprise a pipeline laying installation 19, as is diagrammatically shown in FIG. 1B. The pipeline laying installation 19 may be a reeling installation, constructed to lay a pipeline 35 on a seabed by reeling the pipeline from a reel 34 with the pipeline laying installation 19. In another embodiment, the pipeline laying installation 19 may also be a J-lay installation.

In operation, multiple reels 34 may be positioned on the deck 21 of the vessel 12 for pipeline laying operations. For this end, the vessel comprises one or more reel supports on deck.

A support structure 16 in the form of a crane 16 is provided on the vessel 12. The crane comprises 16 a base 18 via which the crane 16 is connected to the hull 14. The crane further comprises a column 20 which extends upward over a vertical distance. The column 20 is connected to the base 18. Further, the crane 16 comprises a beam 22 which is pivotally connected to the column 20 at a pivot 24 and which extends over a horizontal distance. At least one line 26 extends from an upper part of the column 20 to the beam 22 for maintaining the beam in the desired angle $\alpha$. The line is connected to a winch (not shown) and allows the beam to be pivoted relative to the column 20 over an angle a.

Figure 2A:
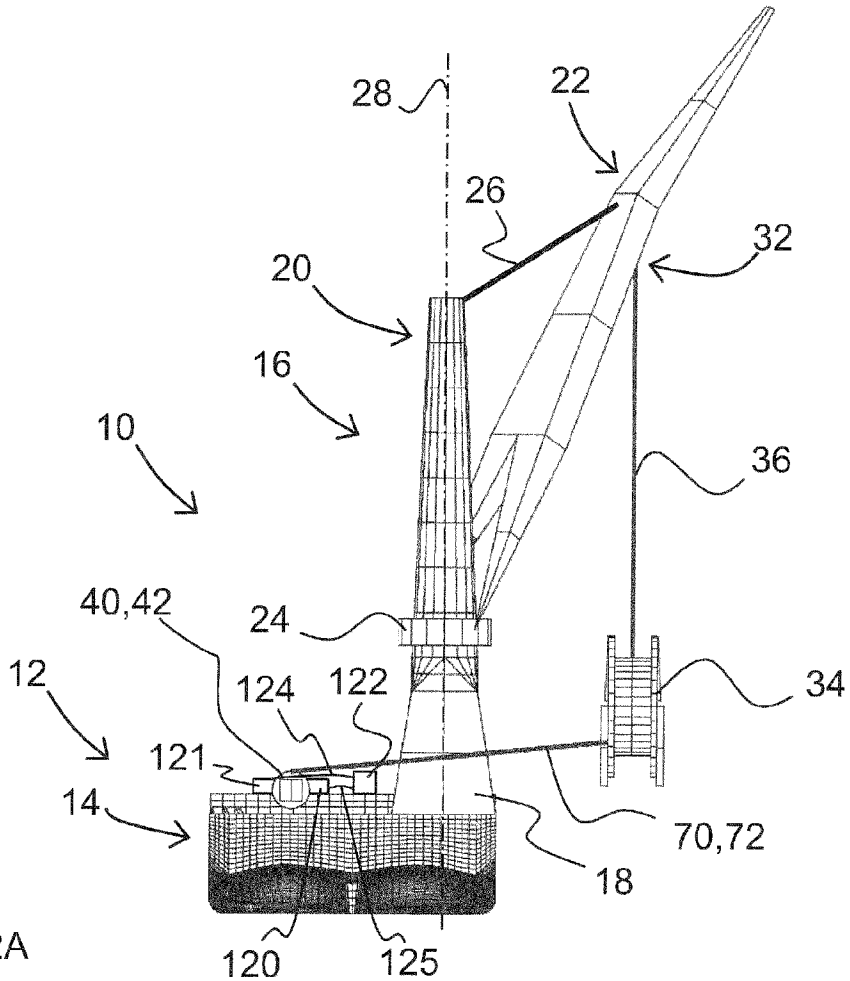
FIG. 2A shows a rear view of the embodiment of FIG. 1.
Figure 2B:
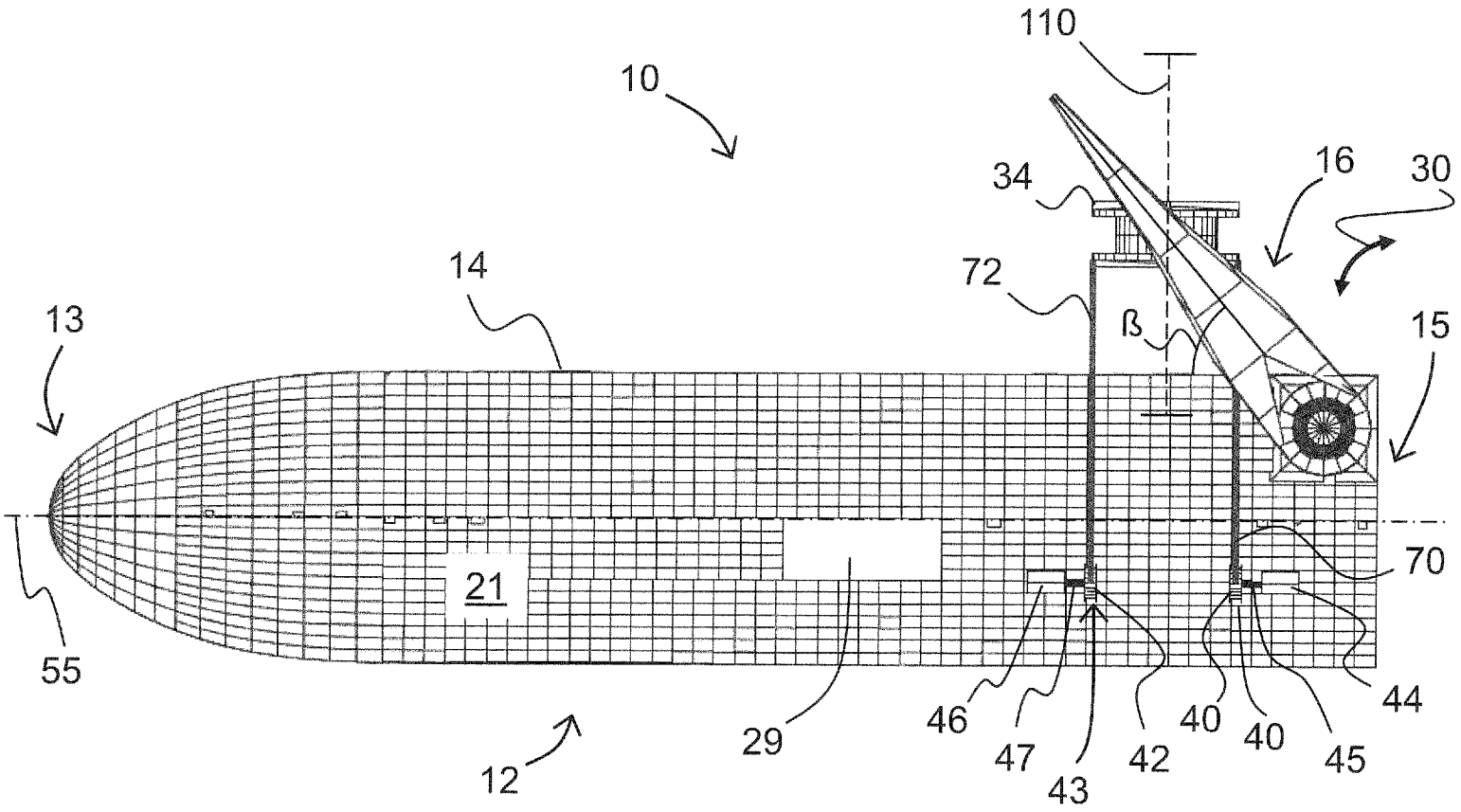
FIG. 2B shows a top view of the embodiment of FIG. 1.

The column 20 and beam 22 are rotatable relative to the hull about a vertical axis 28 of rotation in the direction of arrow 30 over an angle β (shown in FIG. 2B).

A suspension point 32 is provided on the beam 22 from which a load 34 can be suspended via a suspension organ in the form of a line 36. The line 36 is typically connected to a winch 38 on the crane 16 or on the hull 14.

The crane is positioned at one end 15 of the vessel 12, in this case the stern. This allows a relatively large portion of a working range of the crane to be located outboard of a perimeter of the vessel, when seen in top view. In use, the suspension point 32 is located outboard of the perimeter of the hull, when seen in top view, in particular on the right side or left side of the vessel.

It also allows a heavy load to be supported aft of the vessel, such that the entire length of the vessel can contribute in supporting the heavy load, in particular in preventing large rotations of the vessel 12 due to the weight of the load 34. The crane may also be positioned on the bow 15, with a similar effect on the working range.

The crane is positioned at a side of the vessel, in this case the right side. This further increases the outboard working range of the crane.

Cranes of this type are known in the field of the art and a skilled person will understand that different types of cranes exist which have a different construction but similar capabilities.

A damping device 37 comprises two winches 40, 42 which are mounted to the hull of the vessel. The winches 40, 42 define respective support points 41, 43. One winch 40 is located aft of the suspension point 32 and one winch 42 is located forward of the suspension point 32. This provides the benefit that the rotation of the mass 34 can be controlled.

A line 70, 72 extends from each winch 40, 42 to the mass 34. The lines 70, 72 may also be connected to the line 36 at a distance above the mass 34. The lines 70, 72 can be a cable, a chain, a dyneema line or another type of line or a combination of different materials.

The winches 40, 42 are mounted to the deck 21 of the hull. The winches 40, 42 are connected to respective generators 44, 46 via respective axes 45, 47.

The winches 40, 42 are located on an opposite side of a vertical plane 55 as the support construction 16 and the support point 32, wherein the longitudinal plane extends longitudinally and divides the vessel in a left half and a right half, see FIG. 2B. When the support construction 16 is mounted on a left side, the winches 40, 42 are mounted on a right side of the vessel and vice versa. This allows a substantial part of the trajectory to extend above the deck 21, while maintaining the lines 70, 72 horizontally enough to exert a substantial horizontal force on the moving mass 34.

In one embodiment, the damping device 37 comprises at least one first speed sensor 120 which is configured to measure a payout speed of the line 70, 72 from the winch 44, 46. The speed sensor 120 is coupled via line 124 to a control unit 122 which controls the energy dissipation device, so that in use a speed signal is transmitted from the sensor to the control unit. The signal represents the payout speed of the line 70, 72.

A second sensor 121, i.e. a tension sensor 121 is provided which is configured to measure the tension in the line 70, 72 and to generate a tension signal on the basis of the measured tension. The second sensor is coupled to the control unit 122 via a line 125.

Each winch 40, 42 is equipped with a speed sensor 120 and a tension sensor 121, and the control unit 122 is constructed to control both generators 44, 46.

The generators 44, 46 can be switched between two modes:

1. Energy dissipation mode, in which the line 70, 72 is spooled from the winch 40, 42 and the rotating motion of axis 45, 47 is converted into electric energy by the dynamos 44, 46. The damping force applied by the dynamos 44, 46 is adjustable, for instance in dependence of the weight of the mass 34. In energy dissipation mode, the generators 44, 46 act as energy dissipation devices. The tension in the line 70, 72, i.e. the brake torque exerted by the dynamo, for a given speed may be varied by varying the resistance over the dynamo. To this end, the dynamos 44, 46 are equipped with a variable resistor 126, shown in FIG. 1A. Variable resistors 126 are known in the field of the art.

2. Motor mode, in which the generators operate as electric motors and spool the lines 70, 72 onto the winch by a rotary movement. The electric motors 70, 72 use little energy because only energy is required for taking in the excessive line in order to keep the lines 70, 72 taut. The mass 34 itself is substantially not pulled in motor mode.

The load (or mass) 34 is shown as being suspended from the suspension point 32 via a line 36. The load 34 is a reel 34. The load can also be a different kind of load. For the invention, the mass of the load 34 relative to the mass (or water displacement) of the vessel 12 is relevant.

Instead of using dynamos, it is also possible to use controlled disc brakes to control the tension. It is also possible to use the disc brakes in addition to the dynamos, for instance at higher loads. Instead of an electric winch 40, 42, it is also possible to use a hydraulic winch having a hydraulic motor. The hydraulic motor can be use to drive the winch in motor mode and to brake the winch in energy dissipation mode.

Figure 3A:
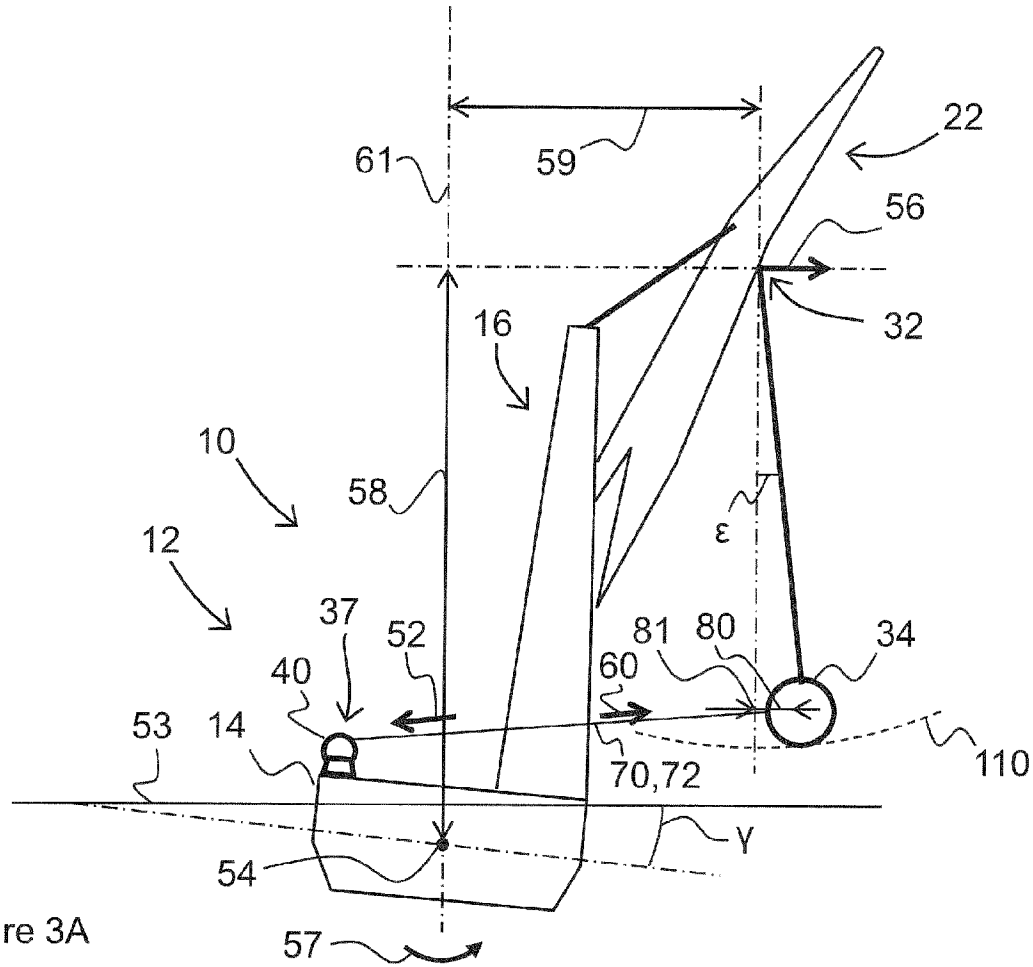
FIG. 3A shows a diagrammatic rear view of the embodiment of FIG. 1.

Turning to FIG. 3A, the system can be modelled as a coupled 2-body rotating mass-spring-damper system. The first body is the vessel 12 which has a certain moment of inertia about the center of gravity 54. The second body is the mass 34 which has a certain moment of inertia about the suspension point 32.

The suspension point 32 is provided at a horizontal distance 59 from a vertical axis 61 extending through the centre of gravity 54.

The first spring is defined by the hull characteristics. i.e. the relation between an angular rotation γ of the hull 14 and a roll moment 57 which is created by the forces of the water on the hull as a result of the rotation.

The first damper is defined by the damping action of the water, i.e. the rotating hull moves the water, and energy is dissipated in the water as a result of the moving water. This dampens the rotating movement of the hull 14. The water line is shown as line 53.

The second spring is determined by the pendular mass 34, i.e. a moment is created on the hull by a horizontal force 56 which is exerted on the suspension point 34 by the line 36 which carries the mass. The horizontal force 56 on the suspension point 34 is determined by the angle of deflection ϵ and the weight of the mass 34 itself. The moment on the hull 14 is determined by the horizontal force 56 on the suspension point (crane tip) 32 multiplied by the vertical distance 58 between the crane tip 32 and the center of gravity 54 of the hull.

The second damper is determined by the line 70, 72 extending between the mass and the winch, and the characteristics of the winch 40, 42 and the generators 45, 47. The damping force 52 is a function of the speed 60 of the mass relative to the support point, i.e. a function of the rotational speed of the generators 45, 47.

Operation

The present system may be used to dampen the motions of a vessel at sea, for instance when there are substantial waves. The motions of the vessel may cause operations to be halted, and the present system can dampen the motions to such an extent that the working conditions of the vessel are extended, i.e. a same vessel can operate in higher waves, and/or greater wind forces.

The system may also be used to dampen the motions of a load which is suspended from the crane, for instance when the load is transferred onto the vessel or from the vessel onto a barge or other delivery point.

In operation, a preference angle a and a preference angle β will be chosen for the crane, such that the position of the suspension point 32, i.e. the vertical distance 58 and the horizontal distance 59, relative to the hull is known. A mass 34 is suspended from the crane 16, for instance by picking the mass 34 up from the deck with the crane. It is also possible to pick up the mass from a barge as is shown in FIG. 1B. The mass 34 is suspended above the water and above the deck.

Figure 3B:
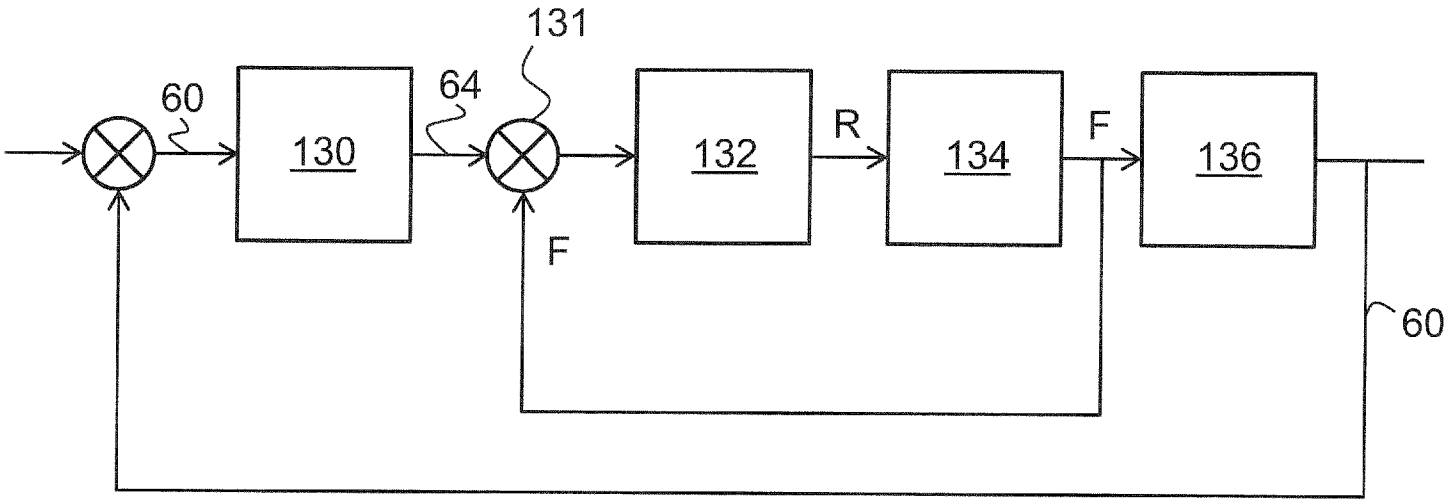
FIG. 3B shows a diagrammatic control diagram of the embodiment of FIG. 1.

The mass 34 is capable of making a pendulum movement along a curved trajectory 110 relative to the vessel, while forming angle ϵ with the vertical axis Turning to FIG. 3B, a control diagram of the system is shown. Control box 130 comprises a predetermined desired relationship between the payout speed 60 of the line 70, 72 and the tension 64 which is to be provided in the line 70,72. This relationship is stored in a memory of the control unit 122 and will be discussed further herein below with regard to FIG. 4B. The measured speed 60 is fed to the control box 130, and a desired tension is calculated. The box 130 has the desired tension as an output, and this desired tension becomes a setpoint.

The setpoint 64 is compared at 131 with an actually measured tension F in the line 70, 72. This actual tension F is measured with tension sensor 121 which is mounted on the winch 40, 42. Box 132 depicts the control algorithm in which the difference between the desired tension 64 and the measured tension F in the line 70, 72 is used in a PID algorithm. With the PID algorithm a desired resistance R of the dynamo 44, 46 is calculated. This desired resistance R is fed to the dynamo 44, 46 in box 134. The variable resistor 126 of dynamo 44, 46 is adjusted accordingly. This results in a tension F of the line 70, 72 which is paid out by the winch 40, 42. The tension F is measured by the tension sensor 121.

The tension force F is exerted on the swaying mass 34 and dampens the motions of the swaying mass 34, which is shown in box 136. This results in a speed of the mass 34, 35 which directly results in a payout speed of the lines 70, 72. The payout speed of the lines is measured by speed sensor 120 which is mounted on each winch 40, 42. The measured speed 60 is fed back to control box 130.

The control diagram is a cascaded control loop, wherein the measured parameter in an outer control loop, i.e. the speed 60, is used to determine the set point, i.e. the force, of an inner control loop.

Figures 4A, 4B, 4C, 4D, 4E:
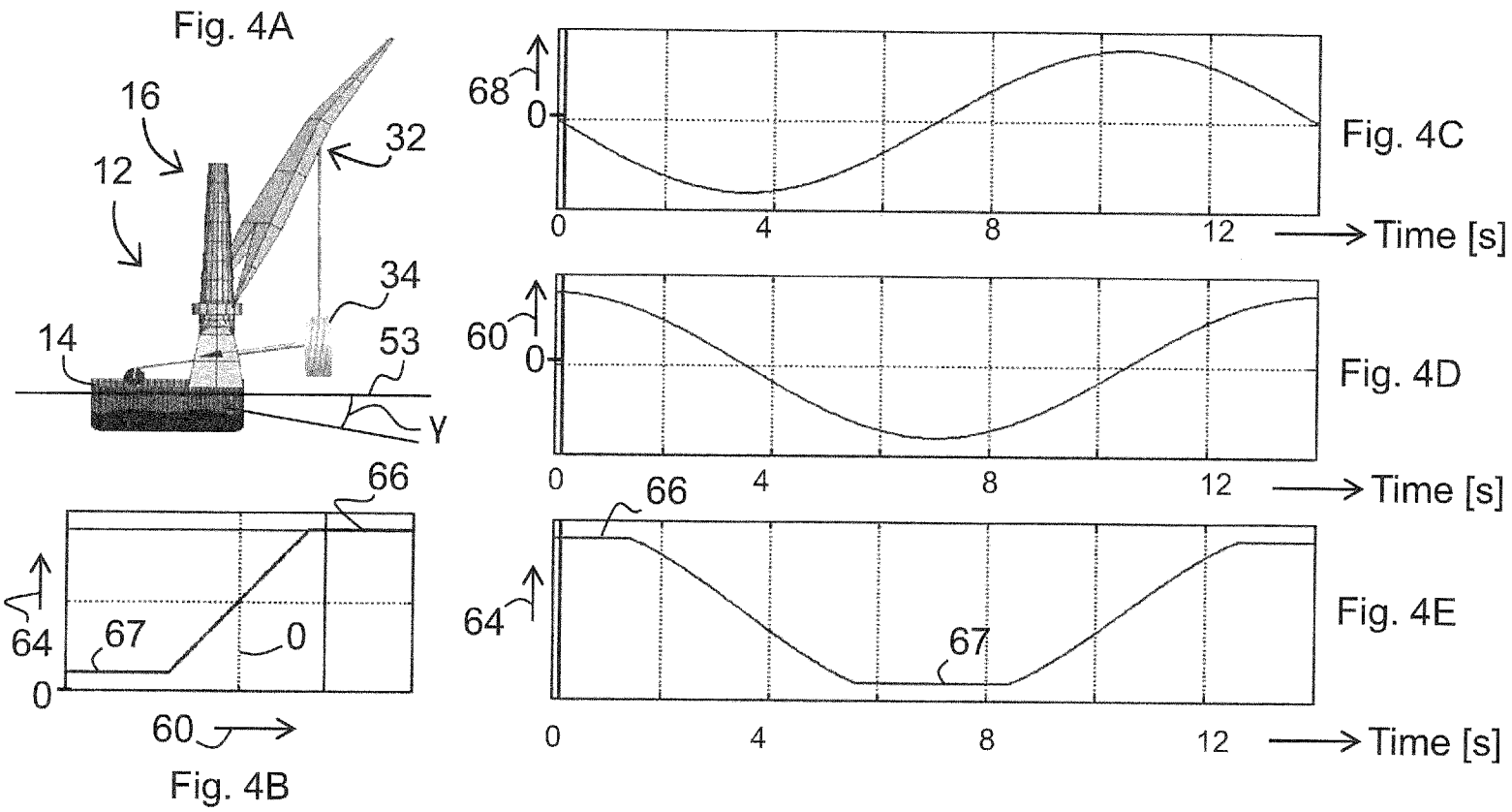
FIG. 4A shows a rear view of the embodiment of FIG. 1.
FIG. 4B shows a graph of a relation between a payout velocity of a line and a tension in the line.
FIG. 4C shows a graph of a position of the mass as a function of the time.
FIG. 4D shows a graph of a payout speed as a function of the time.
FIG. 4E shows a graph of a tension in a line as a function of the time.

Turning to FIGS. 4A, 4B, 4C, 4D and 4E, figures of the system in motion are shown. The figures relate to a rolling motion of the vessel, i.e. about a roll angle y as shown in FIG. 3A and 4A.

FIG. 4B shows a relation between the payout speed 60 of the winch and a tension 64 which is maintained on the line by the generator. The relation is stored in the control unit 122. The payout tension 64 varies between a certain positive maximum tension 66 (paying out the line) and a certain minimum tension.

The payout speed 60 can be positive or negative (i.e. taking in line). The tension 67 is maintained at a certain minimum to keep the line taut. This is carried out by switching the generators 44, 46 to motor mode and taking in the lines 70, 72.

When the pay-out speed 60 is positive, the generators are switched to energy dissipation mode and kinetic energy is converted to electric energy by breaking the winches 40, 42 with the dynamos 44, 46.

In use, a signal is transmitted from the speed sensor 120 to the control unit 122. The signal represents the payout speed of the line. The control unit 122 determines a desired tension, i.e. a setpoint of the tension in the line 70, 72, on the basis of the measured speed and a predetermined speed-tension relationship.

The control unit 122 further receives the tension signal from the tension sensor 121 and compares the measured tension with the setpoint. If the measured tension is lower than the desired tension, the control unit increases the resistance of the variable resistor 126 of the dynamos 44, 46. This is performed via a PID control algorithm. Other algorithms are possible. If the measured tension is greater than the desired tension, the control unit 122 decreases the resistance of the variable resistor 126 of the dynamos 44, 46 via the PID algorithm. In this way the tension in the line 70, 72 is controlled.

Between the minimum tension 67 and the maximum tension 66, the tension 64 is a linear function of the speed 60.

It is also possible that the relation between the speed 60 and the line tension 64 is carried out as a step function or a substantial step function. Such a relationship is also stored in a memory of the control unit 122. This implies that when the mass 34 is moving away from the winch, i.e. at a positive speed 60, the line tension is maintained at a maximum, and when the mass is moving toward the winch, i.e. at a negative speed 60, the line tension is maintained at a minimum.

FIG. 4C shows the position 68 of the mass 34 as a function of time, i.e. the distance 68 to the center 81 of the pendular trajectory. It can be seen that the movement of the mass 34 is a periodical movement which is a substantially sinus function.

FIG. 4D shows the payout speed 60 of the mass 34 as a function of time. It can be seen that the movement of the mass is a periodical movement which is a substantially cosines function, and 90 degrees out of phase with the position function of the mass shown in FIG. 4C.

FIG. 4E shows the tension 64 on the line as a function of time. It can be seen that the line tension varies periodically and has a maximum and a minimum. Between the minimum 67 and the maximum 66, the tension varies substantially as a cosines function.

Figure 5B:
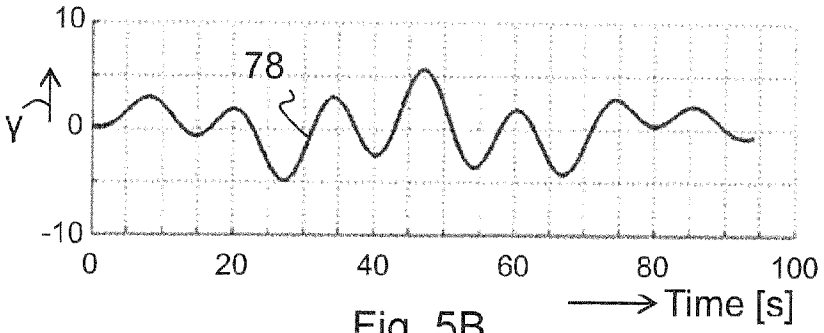
FIG. 5B shows a graph of a roll angle of the vessel as a function of time during wave action and with an undamped system.
Figure 5C:
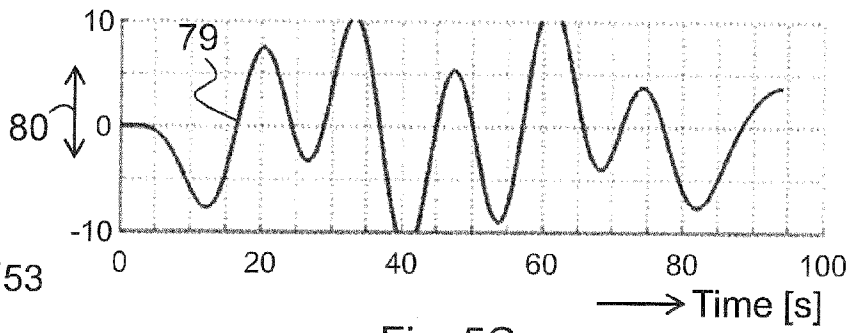
FIG. 5C shows a graph of a position of the mass as a function of time during wave action and with an undamped system.
Figure 5A:
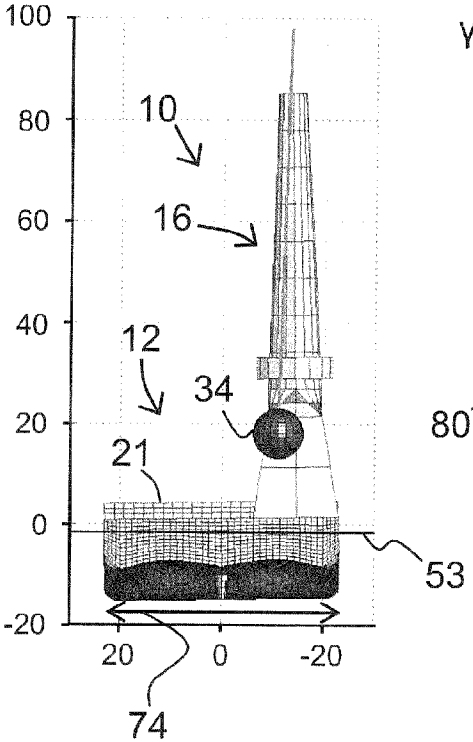
FIG. 5A shows a rear view of the embodiment of FIG. 1.

Turning to FIGS. 5A, 5B, 5C, a simulation is shown wherein a mass 34 is suspended from the crane, and no damping is provided on the mass. Waves occur and are taken into account in the simulation. This simulation relates to a situation wherein a load 34 such as a reel 34 would be transferred from a barge which is positioned alongside the 15 vessel onto the vessel 12, without damping the movements of the load 34 via lines 70, 72.

FIG. 5A shows the size of the simulated vessel. The suspension point 32 is located more than 100 meters above the water level 53. The upper deck is about 4-5 meters above water level 53 and the mass 34 is suspended at a distance of about 18 meters above the water level 53. The width 74 of the vessel is about 44 meters. The waves that are taken into account are waves which can be encountered in real life in different parts of the world.

FIG. 5B shows that the roll angle γ of the vessel varies in time and reaches highest peaks 78 of about 6 degrees.

FIG. 5C shows that the deflection 80 of the mass varies in time and reaches highest peaks 79 of more than 10 meters outwards. This situation would be unacceptable in real life, as there would be an unacceptable risk for personnel and equipment. Thus, if this system were used in real life, it would not be possible to lift a reel in this way from a barge onto the vessel 10 under these wave conditions. It would then be necessary to wait until the sea would become calmer. This could delay pipeline laying operations (or any other operation) substantially and result in unacceptable downtime of the vessel.

Figure 5D:
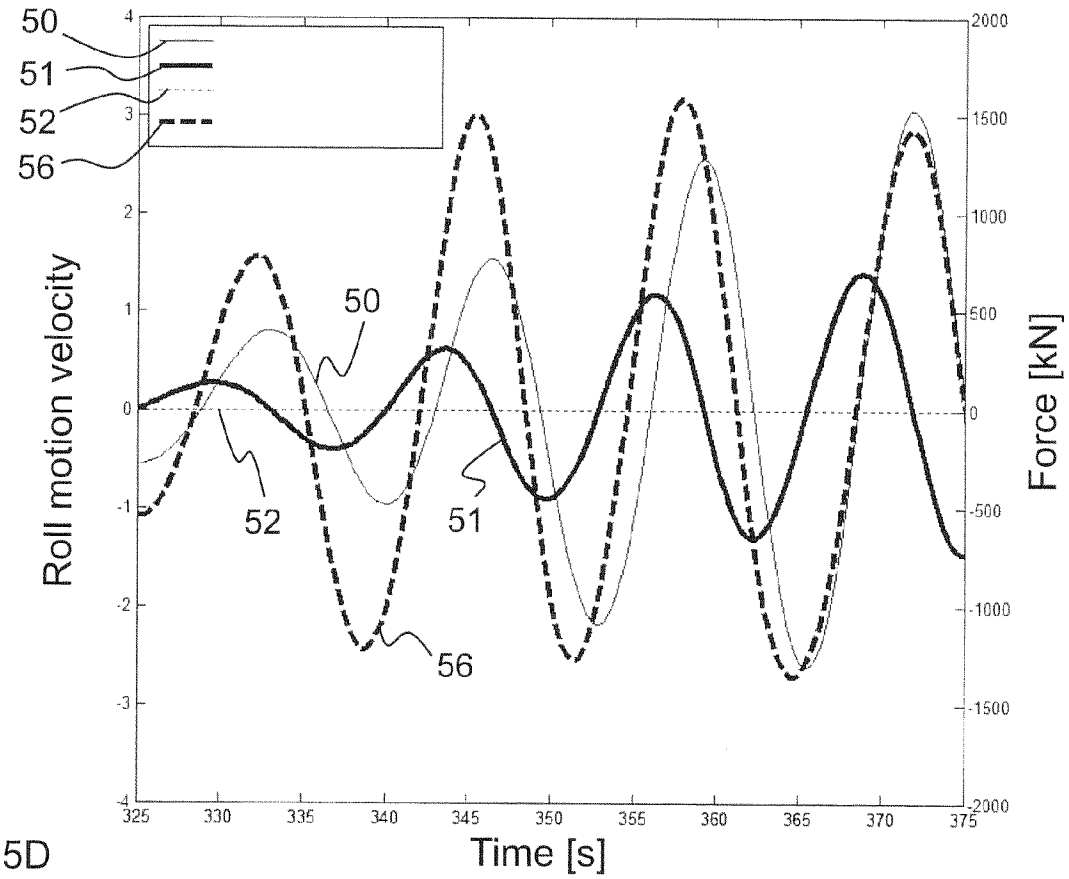
FIG. 5D shows several parameters as a function of time during wave action and with an undamped system.

FIG. 5D shows another simulation, in which the roll motion 50 (or angle γ in degrees) of the vessel, the roll velocity 51 in deg/s, the damper force 52 (which is zero) in kN, and the horizontal force 56 on the crane tip 32 in kN are shown. The damping force is zero. The crane tip force 56 is in phase with the roll motion 50 and thus a spring force, i.e. the mass acts as a spring. The specific wave height Hs=1.5 m, and the time period of the 35 waves is Tp=12 seconds.

Figure 6B:
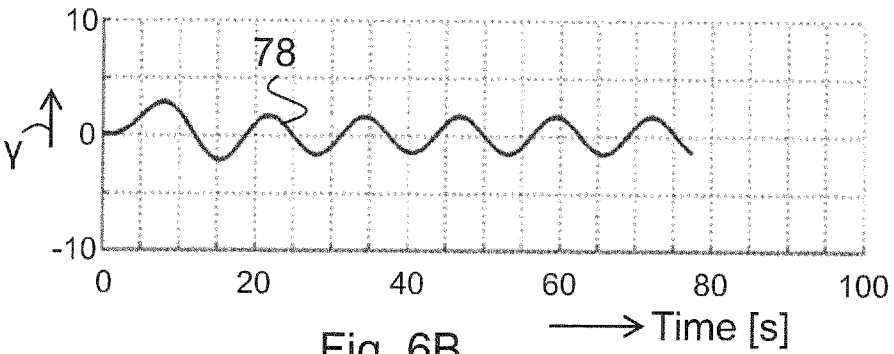
FIG. 6B shows a graph of a roll angle of the vessel as a function of time during wave action and with a damped system.
Figure 6C:
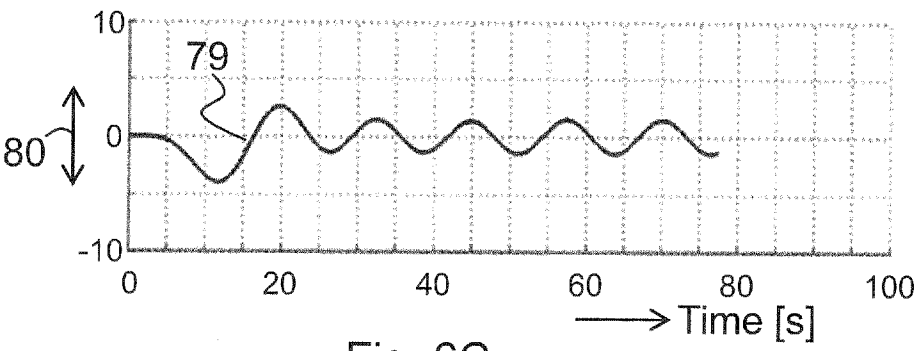
FIG. 6C shows a graph of a position of the mass as a function of time during wave action and with a damped system.
Figure 6A:
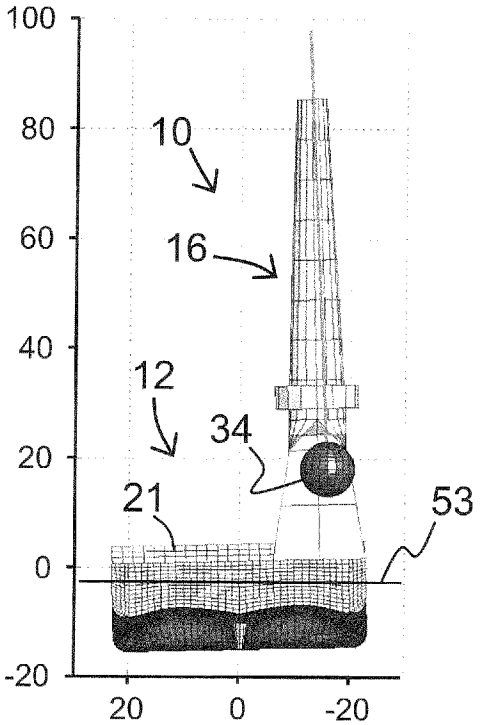
FIG. 6A shows a rear view of the embodiment of FIG. 1.

Turning to FIGS. 6A, 6B and 6C, a system similar to the system of FIGS. 5A-5D is simulated under similar conditions, but now with a damping system as is shown in FIGS. 1-3.

It can be seen in FIG. 6B that the roll motion of the vessel is significantly reduced in comparison with FIG. 5B. The peaks 78 in the roll angle are about 2 degrees, which is significantly lower than the peaks of 6 degrees shown in FIG. 5B.

FIG. 6C shows that the motions of the reel 34 are substantially reduced in comparison with FIG. 5C. In the damped situation, peaks 79 of about 2 meters occur, which is acceptable.

Figure 6D:
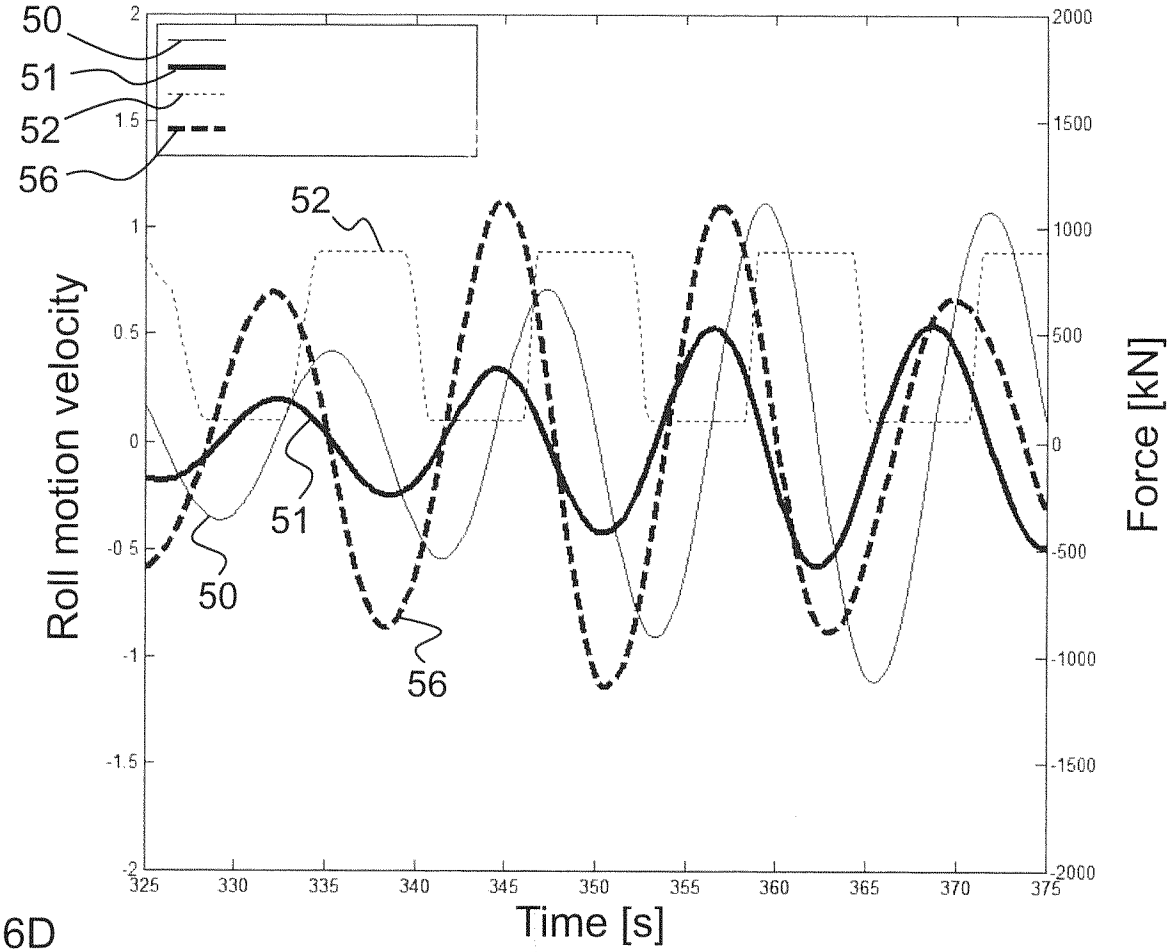
FIG. 6D shows several parameters as a function of time during wave action and with a damped system.

FIG. 6D shows another simulation with the damping system on. The roll motion 50 of the vessel, the roll velocity 51, the damper force 52, and the force 56 on the crane tip are shown. The specific wave height Hs=1.5 m, and the time period of the waves is Tp=12 seconds, i.e. the same as in FIG. 5D. In comparison with FIG. 5D, the roll velocity 51 of the vessel and the force 56 on the crane tip are significantly reduced.

Figure 7:
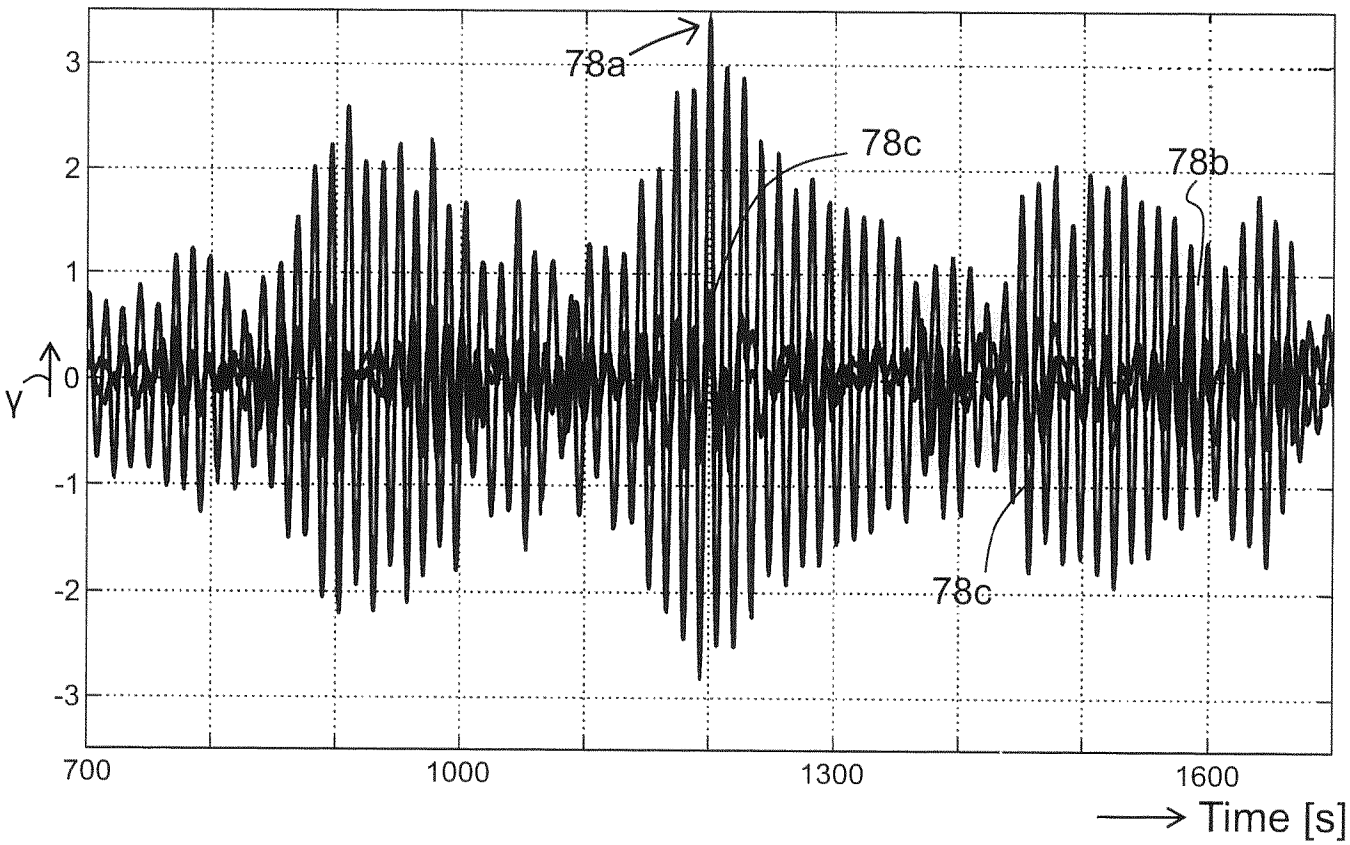
FIG. 7 shows a graph of model tests showing the roll angle of the vessel as a function of time in waves in different configurations of the damping system.

Turning to FIG. 7, the roll angle γ of the vessel 12 is shown as a function of time, in a configuration 90 without any line between the mass 34 and the vessel 12. The graphs are results of actual model tests. Peaks 78*a* in the roll angle are in the order of 3.5 degrees. With a linear damper, the peaks 78*b* are less than 1 degree. With a step wise damper, peaks 78*c* occur which are about 1 degree.

Figure 8:
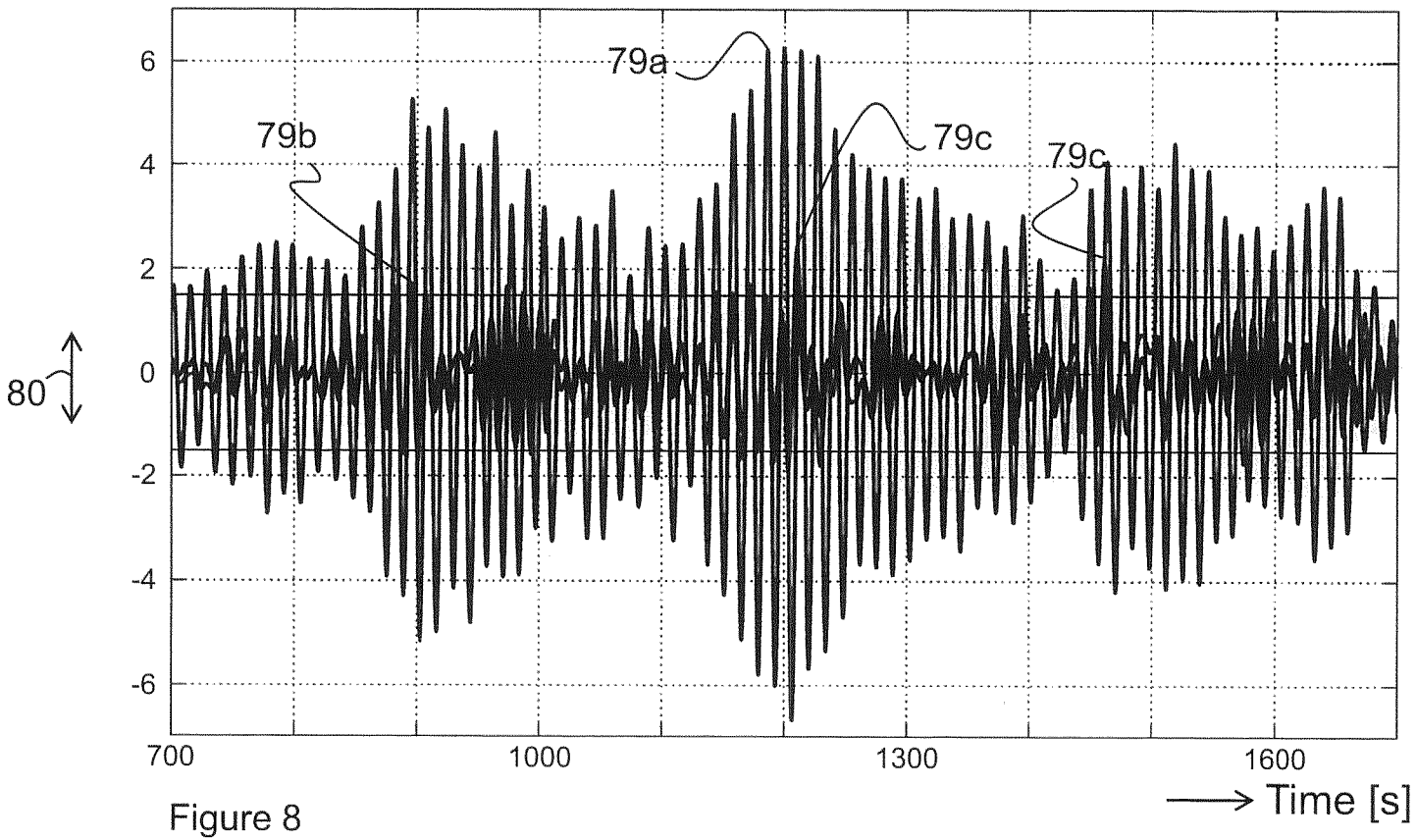
FIG. 8 is a graph of model tests showing the position of the mass as a function of time in waves in different configurations of the damping system.

Turning to FIG. 8, the deflection 80 of the mass 34 is shown in meters as a function of time, in a configuration 90 without any line between the mass 34 and the vessel 12. The graphs are results of actual model tests. Peaks 79*a* in the deflection 80 are in the order of 6 meter. With a linear damper, the peaks 79*b* are about 1.8 meter, i.e. less than 2 meter. With a step wise damper, peaks 79*c* occur which are about 2.3 meter.

Figure 9:
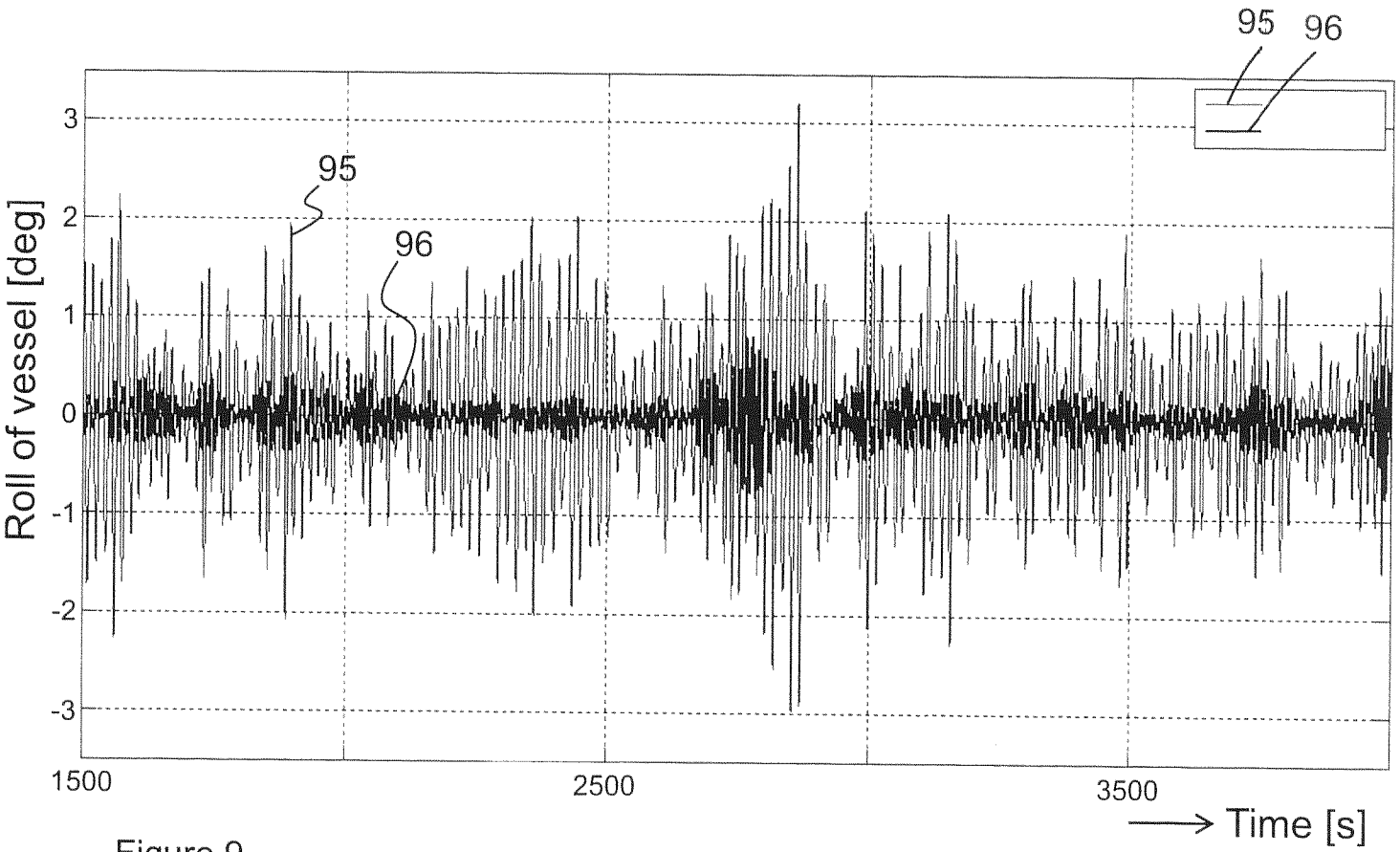
FIG. 9 shows a comparison between an undamped vessel and a damped vessel.

Turning to FIG. 9, a graph 95 is shown of a vessel without any damping system and without a mass 34 suspended from the crane, and a graph 96 of a same vessel but with a suspended mass 34 damped by a damping system according to the invention. For the undamped vessel, peaks in the roll angle occur of more than 3 degrees. For the damped vessel, peaks occur of less than 1 degree. The invention thus provides a substantial advantage.

Further Embodiment

Figure 10:
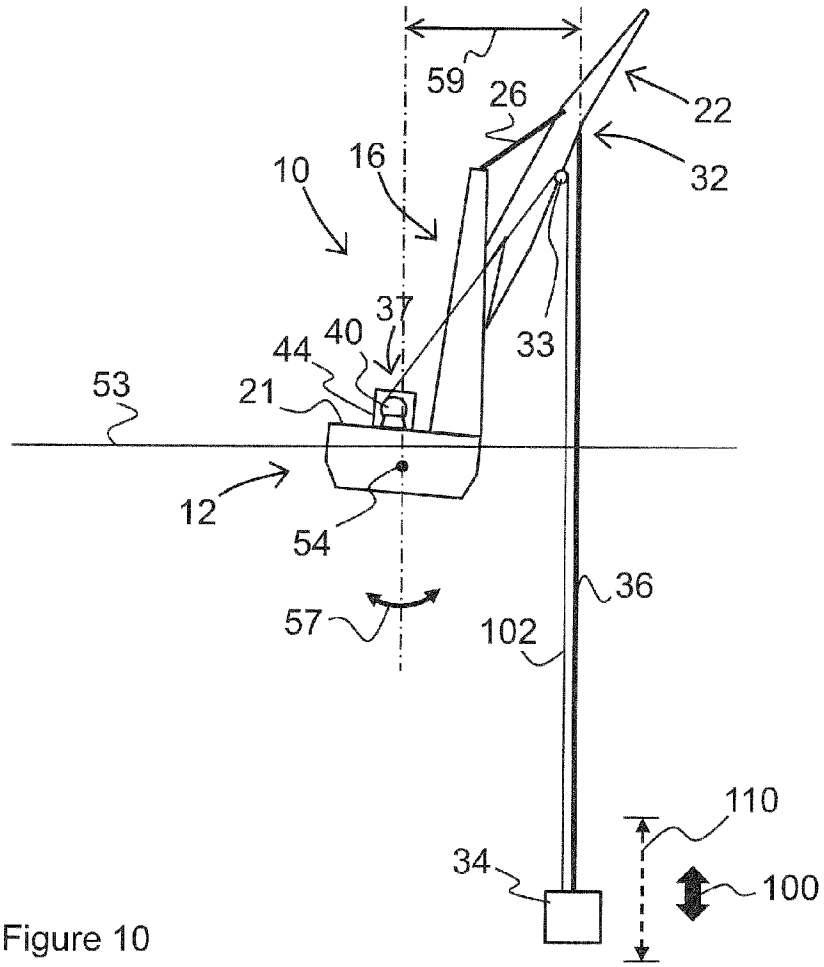
FIG. 10 shows a rear view of another embodiment of the invention.

Turning to FIG. 10, another embodiment of the invention is shown. The mass 34 is suspended under water via one or more lines 36. The suspension point 32 is provided at a horizontal distance 59 from a vertical axis 61 extending through the centre of gravity 54. Due to a rolling motion of the vessel 12 in the direction of arrow 57, about the center of gravity 54, the mass will start to oscillate in a vertical direction 100. The line 36 has an elasticity according to Hooke's law and acts as a spring.

A second line 102 extends between a second suspension point 33 and the mass 34. The second line 102 extends substantially alongside and parallel to the first line 36. The second line 102 is reeved via the suspension point 33 to a winch 40 mounted on the deck 21 of the vessel. The second line 102 is configured and arranged to in use act as a damper for damping the vertical oscillation of the mass 34. The winch is coupled to a generator 44.

In use, the vessel rolls about its roll axis as a result of waves. The suspension point 32 makes a movement along a part of a circular arc 105 with the center of gravity 54 as the center of the circle. The movement of the suspension point 32 comprises both a horizontal component and a vertical component. The vertical component causes a vertical oscillation of the mass. The mass moves up and down (i.e. back and forth) along trajectory 110.

A length of the line 36, i.e. a depth of the mass 34, may be varied in order to vary the spring constant, if required. Multiple cables 36 may be provided.

When the mass 34 moves upwards relative to the suspension point 33, the generator acts as a motor to haul in excessive line 102. When the mass 34 moves downwards relative to the suspension point 32, the generator 44 acts as a brake which dampens the downward movement of the mass.

The action of the dampening line 102 works in addition to a dampening effect of the 20 water itself, which dampens the vertical oscillating of the mass 34.

In this way, the rolling motion of the vessel is dampened. This embodiment can do without a heavy weight which moves above the deck of the vessel.

It will be understood by a person skilled in the art, that the scope of the invention is not limited to the embodiments shown in the figures. Many variants and combinations are possible and are also envisaged, and the scope of the invention is only limited by the claims.

The invention claimed is:

1. A vessel, comprising:

a hull;

a support structure connected to said hull, the support structure configured for supporting a mass, the support structure being constructed to allow the mass to make a back and forth movement relative to said hull along a trajectory, between opposite ends of said trajectory;

a damping device configured to dampen the movement of the mass relative to said hull, wherein the damping device comprises:

a winch positioned at a support point on said hull, wherein one end of a line is spooled on the winch, wherein the line connects the support point on the hull with the mass, the winch and the line being constructed to apply a damping force on the mass, and wherein the winch is constructed to pay out the line during a movement of the mass away from the support point, and to take in the line during a movement of the mass toward the support point;

an energy dissipation device which is coupled to the winch, the energy dissipation device being constructed to dissipate energy from the moving mass;

at least one speed sensor which is configured to measure a payout speed of the line from the winch and to generate a speed signal on the basis of the measured speed;

at least one tension sensor which is configured to measure a tension in the line and to generate a tension signal on the basis of the measured tension;

a control unit which is coupled to the speed sensor and to the tension sensor, the control unit being configured to:

determine a desired tension in the line on the basis of the speed signal and a stored relationship between the payout speed and the tension force; and control the energy dissipation device in dependence of a difference between the desired tension and the actual tension measured by the tension sensor;

wherein the damping device is constructed to provide a damping force on the mass which is maximized, such that if the speed of the mass exceeds a certain value, the damping force does not exceed a predetermined maximum value; and wherein the damping device is constructed to provide a damping force on the mass which is minimized for a maximum speed of the mass in a direction toward the support point, such that if the speed of the mass in a direction toward the support point on the hull exceeds a certain value, the damping force on the line does not fall below a predetermined minimum value, in order to ensure that the line remains taut.

2. The vessel according to claim 1, the support structure extending over a vertical distance from a centre of gravity of the vessel, providing a suspension point at a vertical distance from the centre of gravity of said hull, the damping device further comprising an elongate suspension organ via which the mass is suspended as a pendulum from the suspension point, wherein the mass makes a pendular movement relative to said hull, and wherein the damping device dampens the pendular movement of the mass relative to the hull.

3. The vessel according to claim 1, wherein the damping device requires no external energy for damping the movement of the mass relative to said hull.

4. The vessel according to claim 1, wherein the damping device is constructed and arranged to provide a damping force which is:

substantially linearly dependant on the speed of the mass; or substantially a step function of the speed of the mass, wherein the damping force has a first substantially fixed value when the mass moves in one direction, and wherein the damping force has a second substantially fixed value when the mass moves in substantially the opposite direction.

5. The vessel according to claim 1, comprising at least a first line and second line, and at least a first and second support point, wherein the first support point and second support point are spaced apart in a direction perpendicular to the trajectory, the vessel further comprising:

the first line, which is configured to connect the first support point on the hull with the mass, and which is constructed to apply a first damping force on the mass;

a first winch on which one end of the first line is spooled;

a first energy dissipation device which is coupled to the first winch; and the second line, which is configured to connect the second support point on the hull with the mass, and which is constructed to apply a second damping force on the mass;

a second winch on which one end of the second line is spooled;

a second energy dissipation device which is coupled to the second winch, wherein the first winch and second winch are spaced apart in a direction perpendicular to the trajectory.

6. The vessel according to claim 2, wherein the support structure extends over a horizontal distance from the hull and is constructed and arranged to support the mass at a depth under water via the elongate suspension organ, wherein the elongate suspension organ has an elasticity and is constructed to act as a spring which allows an up-and-down oscillation of the mass when the vessel makes a rolling movement, wherein the line extends substantially vertically from the support structure to the mass.

7. The vessel according to claim 1, wherein the support structure extends upwards from the hull, wherein the mass is provided above the water level and is supported higher than the upper deck of the hull, wherein at least a part of the trajectory extends above the upper deck, wherein —when seen in top view —the trajectory is located eccentric to a longitudinal plane of symmetry of said hull, and wherein —when seen in top view —a suspension point of the mass is located outboard of the perimeter of the hull, in particular on the right side or left side of the vessel, and wherein the support structure is a crane, wherein the crane is positioned at a distance of less than 15 percent of a total length of the vessel from the bow or stern, and wherein the damping device does not comprise a rail constructed for guiding the moving mass.

8. A damping device constructed and arranged for damping the movement of a vessel or of a mass, the damping device comprising:

a support structure constructed to be positioned on a hull of the vessel and configured for supporting the mass, the support structure being constructed to allow the mass to make a back and forth movement relative to said hull along a trajectory, between opposite ends of said trajectory;

a winch positioned at a support point, wherein one end of a line is spooled on the winch, wherein the line connects the support point with the mass, the winch and the line being constructed to apply a damping force on the mass, wherein the winch is constructed to pay out the line during a movement of the mass away from the support point, and to take in the line during a movement of the mass toward the support point;

an energy dissipation device which is coupled to the winch;

at least one speed sensor which is configured to measure a payout speed of the line from the winch and to generate a speed signal on the basis of the measured speed;

at least one tension sensor which is configured to measure a tension in the line and to generate a tension signal on the basis of the measured tension; and a control unit which is coupled to the speed sensor and to the tension sensor, the control unit being configured to:

determine a desired tension in the line on the basis of the speed signal and a stored relationship between the payout speed and the tension force; and control the energy dissipation device in dependence of a difference between the desired tension and the actual tension measured by the tension sensor;

wherein the damping device is constructed to provide a damping force on the mass which is maximized, such that if the speed of the mass exceeds a certain value, the damping force does not exceed a predetermined maximum value; and wherein the damping device is constructed to provide a damping force on the mass which is minimized for a maximum speed of the mass in a direction toward the support point, such that if the speed of the mass in a direction toward the support point on the hull exceeds a certain value, the damping force on the line does not fall below a predetermined minimum value, in order to ensure that the line remains taut.

9. A method of stabilizing a mass or a vessel, the method comprising:

providing a vessel and a mass, wherein the vessel comprises:

a hull;

a support structure connected to said hull, the support structure configured for supporting the mass, the support structure being constructed to allow the mass to make a back and forth movement relative to said hull along a trajectory between opposite ends of said trajectory; and a damping device configured to dampen the movement of the mass relative to said hull;

wherein the damping device comprises:

a winch positioned at a support point on said hull, wherein one end of a line is spooled on the winch, wherein the line connects the support point on said hull with the mass, the winch and the line being constructed to apply a damping force on the mass, wherein the winch is constructed to pay out the line during a movement of the mass away from the support point, and to take in the line during a movement of the mass toward the support point;

an energy dissipation device which is coupled to the winch, the energy dissipation device being constructed to dissipate energy from the moving mass;

at least one speed sensor which is configured to measure a payout speed of the line from the winch and to generate a speed signal on the basis of the measured payout speed;

at least one tension sensor which is configured to measure a tension in the line and to generate a tension signal on the basis of the measured tension; and a control unit which is coupled to the speed sensor and to the tension sensor, the control unit being configured to:

determine a desired tension in the line on the basis of the speed signal and a stored relationship between the payout speed and the tension force; and control the energy dissipation device in dependence of a difference between the desired tension and the actual tension measured by the tension sensor;

wherein the damping device is constructed to provide a damping force on the mass which is maximized, such that if the speed of the mass exceeds a certain value, the damping force does not exceed a predetermined maximum value; and wherein the damping device is constructed to provide a damping force on the mass which is minimized for a maximum speed of the mass in a direction toward the support point, such that if the speed of the mass in a direction toward the support point on the hull exceeds a certain value, the damping force on the line does not fall below a predetermined minimum value, in order to ensure that the line remains taut;

damping a movement of the mass relative to the vessel with the damping device, wherein the damping comprises:

measuring the payout speed of the line from the winch with the speed sensor and generating the speed signal on the basis of the measured speed;

measuring the tension in the line with the tension sensor and generating the tension signal on the basis of the measured tension;

determining the desired tension in the line on the basis of the speed signal and the stored relationship between the payout speed and the tension force by the control unit; and controlling the energy dissipation device in dependence of the difference between the desired tension and the actual tension by the control unit.

10. The method of claim 9, further comprising:

providing the support structure which extends over a vertical distance from said hull, thereby providing a suspension point at a vertical distance from said hull, the damping device further comprising an elongate suspension organ via which the mass is suspended as a pendulum from the suspension point, the mass being able to make a pendular movement relative to said hull, the pendular movement defining the trajectory, wherein the damping device is configured to dampen the pendular movement of the mass;

allowing the mass to make a pendular movement; and damping a movement of the mass relative to the vessel with the damping device.

11. The method of claim 9, wherein the method comprises dampening the roll motion of the vessel about at least one axis.

12. The method of claim 9, wherein the vessel comprises a reeling device for laying pipeline, the method comprising transferring a reel with pipeline spooled onto the reel to the vessel, wherein the damping device dampens the motion of the reel and/or the vessel during the transfer of the reel.

* * * * *